US005743319A

United States Patent [19]

Christopherson

[11] Patent Number: 5,743,319

[45] Date of Patent: Apr. 28, 1998

[54] WINDOW BLIND WITH SAFETY PULL CORD

[76] Inventor: Herman P. Christopherson, 18321 Deer Run Ct., Prior Lake, Minn. 55372

[21] Appl. No.: 779,842

[22] Filed: Jan. 7, 1997

[51] Int. Cl.[6] ..... E06B 9/30

[52] U.S. Cl. ..... 160/173 R; 160/178.1 R

[58] Field of Search ..... 160/173 R, 178.1 R, 160/168.1 R, 172 R, 176.1 R, 177 R, 170 R, 171 R, 84.01, 84.04, 84.05, 84.06

[56] References Cited

U.S. PATENT DOCUMENTS

| | | | |
|---|---|---|---|
| 2,547,260 | 4/1951 | Foglio | 160/178.1 R X |
| 2,578,749 | 12/1951 | Schultz | 160/178.1 R X |
| 3,100,013 | 8/1963 | Randmark | 160/168.1 R |
| 5,375,642 | 12/1994 | Gaber et al. | 160/168.1 R |
| 5,495,883 | 3/1996 | Jelic | 160/178.1 R X |

OTHER PUBLICATIONS

Excerpts from Apr. 26, 1995 Deposition of Herman P. Christopherson.

*Primary Examiner*—David M. Purol

[57] ABSTRACT

An improved window blind wherein the pull cord has an inner element and an outer element, the inner element performing the lifting and lowering function of the pull cord, and the longitudinally compressible outer element encompassing the inner element and being either affixed to the slats or restricted from being pulled through the cord holes to prevent outward pulling of the pull cord from the window blind to create a hazardous loop.

6 Claims, 10 Drawing Sheets

WINDOW BLIND WITH SAFETY PULL CORD

BACKGROUND

Window blinds, also known as venetian blinds or mini blinds, are well known for residential use as a window covering. They generally have a bottom rail, a head rail, and pull cords connecting the bottom rail to the head rail. The conventional window blind also has a multitude of relatively flat slats, with a flexible ladder mechanism for spacing and tilting the slats. The pull cords pass through holes in the slats. As the pull cords are pulled, the bottom rail rises and lifts the slats above it as it moves toward the head rail. As the pull cords are loosened, the weight of the bottom rail pulls the bottom rail down and the slats fall into place on the ladder mechanism. The window blinds also have a mechanism for adjusting the ladder mechanism so as to change the angle of the slats and control the amount of light entering the room.

Window blinds, including the popular mini blinds with narrow slats, have slats spaced between a bottom rail and head rail, and have pull cords running through the slats at a hole near each end of each slat. Each pull cord runs through the slats from bottom to top and then continues down one side of the blinds to allow the bottom rail and slats to be pulled up or lowered. The pull cord on window blinds has been the cause of serious injury and death to babies and small children who have, through curiosity or otherwise, grasped the pull cord between the slats, pulled it outward toward themselves, and become entangled in it.

For the foregoing reasons, there is a need for a window blind with a safety pull cord which cannot be separated from the window blind slats and which cannot, therefore, be pulled out a dangerous length from the window blind slats.

SUMMARY

The present invention is directed to an apparatus that solves the problem and satisfies the need described above.

My invention is for an improved window blind which has a bottom rail and a head rail, and has two or more pull cords connecting the bottom rail to the head rail for raising and lowering the window blind. The window blind has multiple slats between the bottom rail and the head rail, and each of the slats has a hole for each the pull cord to pass through; the holes in the slats are aligned with the pull cords. The pull cord of my invention has an inner element and a longitudinally compressible outer element. The inner element is the mechanism for raising and lowering the bottom rail and the slats. The outer element encompasses the inner element, is made of longitudinally compressible material, and is attached to at least one of the slats or is restricted from being pulled through the cord holes. Where the outer element is attached to the slat or rails, or is restricted from passing through the cord holes, the pull cord cannot be pulled outward from the slat, and thus cannot create the hazard of an extended length of pull cord in the hands of a baby or toddler.

BRIEF DESCRIPTION OF THE DRAWINGS

These and other features, aspects, and advantages of the present invention will become better understood with regard to the following description, appended claims, and accompanying drawings where:

DESCRIPTION

The improved window blind of my invention is similar to known window blinds, differing only in its pull cords. In my invention the pull cords are restrained at the slat so that a pull cord cannot be pulled out and away from the slats to create a hazardous loop. In the following detailed description like part numbers are used with like components throughout.

Figure 1:
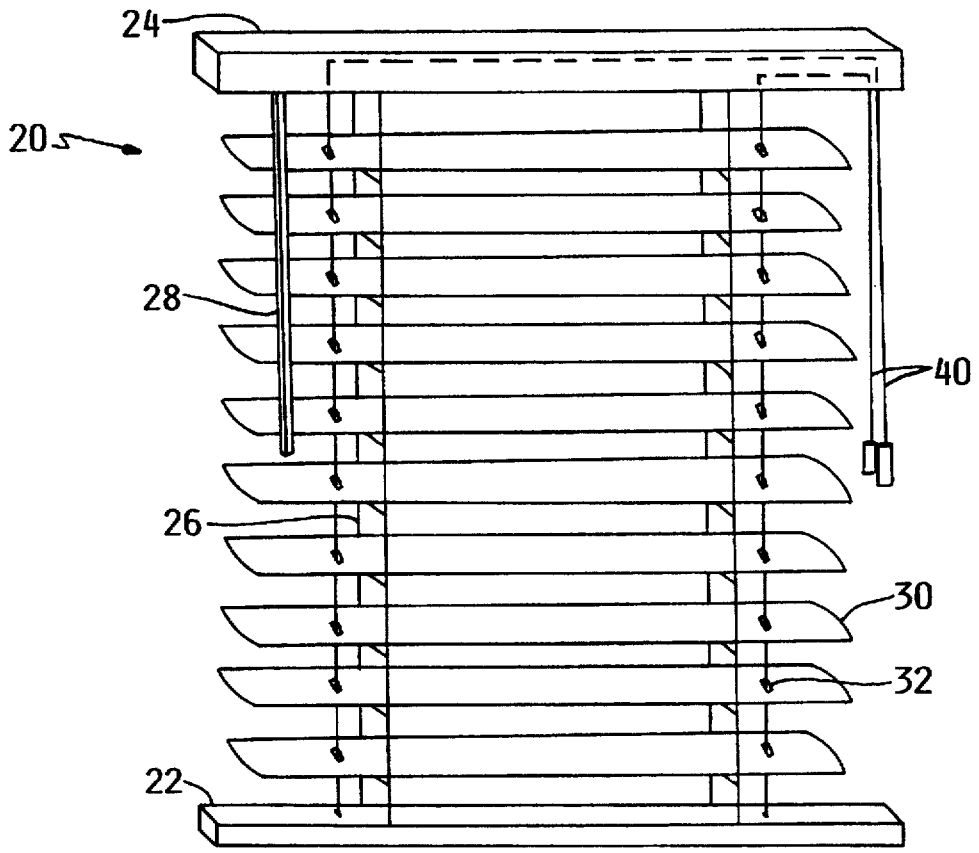
FIG. 1 shows a typical window blind as installed at a window.

As shown in FIG. 1, the window blind 20 has a bottom rail 22 and a head rail 24. A multitude of generally flat slats 30 are spaced between the bottom rail 22 and the head rail 24 by a ladder 26. The ladder 26 is interconnected with an adjuster 28 which controls the pitch of the slats 30 to adjust the amount of light passing through the window blind 20. Each pull cord 40 is attached to the bottom rail 22, passes through each slat, is interconnected with the head rail 24, and passes across the head rail 24 and down one side of the window blind to form the mechanism for raising and lowering the window blind.

Figure 2:
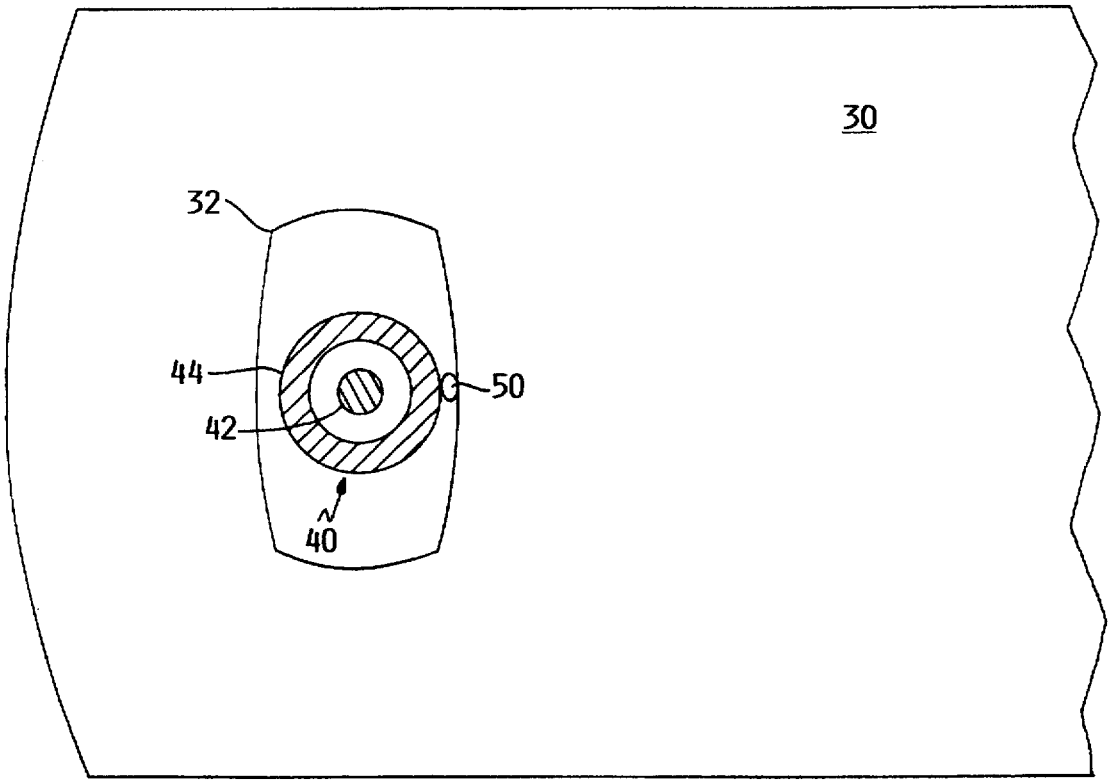
FIG. 2 shows a plan view of one end of a window blind slat and pull cord with one embodiment of my invention wherein the outer element of the pull cord is affixed directly to the slat.

Each pull cord 40 is attached to the bottom rail 22, passes through a cord hole 32 in each slat, and is interconnected with the head rail 24. In my invention, the pull cord 40 has an inner element 42 and an outer element 44, as shown in FIG. 2. The outer element 44 may be the full height of the window blind 20 or a shorter length to cover certain portions of the pull cord 40 and protect specific parts of the window blind 20. The outer element 44 terminates at or before the head rail 24 while the inner element 42 passes across the head rail 24 and down one side of the window blind to form the mechanism for raising and lowering the window blind. Each slat 30 is generally flat and has a cord hole 32 at each of its ends for passage of the pull cord 40 through the slat.

FIG. 2 depicts one end of a typical slat 30 with one embodiment of my invention. In my invention the pull cord 40 is comprised of an inner element 42 and an outer element 44. The inner element 42 is freely movable within the outer element 44 and performs the lifting and lowering function of a conventional window blind pull cord. The outer element 44 of the pull cord 40 is comprised of a longitudinally compressible material such as flexible polyester, cotton, or nylon. The outer element 44 of one embodiment of my invention is a woven tube such as that used in shoe laces. The outer element 44 fully encloses the inner element 42. The outer element 44 is bonded to the slat 30 in any suitable manner. In the embodiment shown in FIG. 2, the outer element 44 is bonded to the side of the cord hole 32 with bond 50 such as glue or the like. It is preferable to affix the outer element 44 to the cord hole 32 at a point near the crosswise center of the slat 30 to avoid interference with the pitch altering function of the ladder 26 and adjuster 28. Other methods of bonding the outer element 44 to the cord hole 32 will be apparent to those skilled in the art. As the inner element 42 of the pull cord 40 is pulled to raise the bottom rail 22 and the slats 30 of the window blind, the outer element 44 compresses between the slats 30. In one embodiment of my invention the outer element 44 is attached to each of the slats 30; this embodiment provides the greatest safety benefit, for if the slats are spaced at one inch intervals, the maximum length of pull cord 40 which can be pulled outward from the window blind is one-half inch. Alternative embodiments would attach the outer element 44 to alternate slats 30 or to every third or fourth slat 30 to lessen the length of pull cord 40 which can be pulled outward from the window blind to a length which will not create a serious risk of injury. Depending on the use of the window blind, its full height may not need this protection; for example, protecting the lower third or half may be adequate protection for small children.

Figure 3:
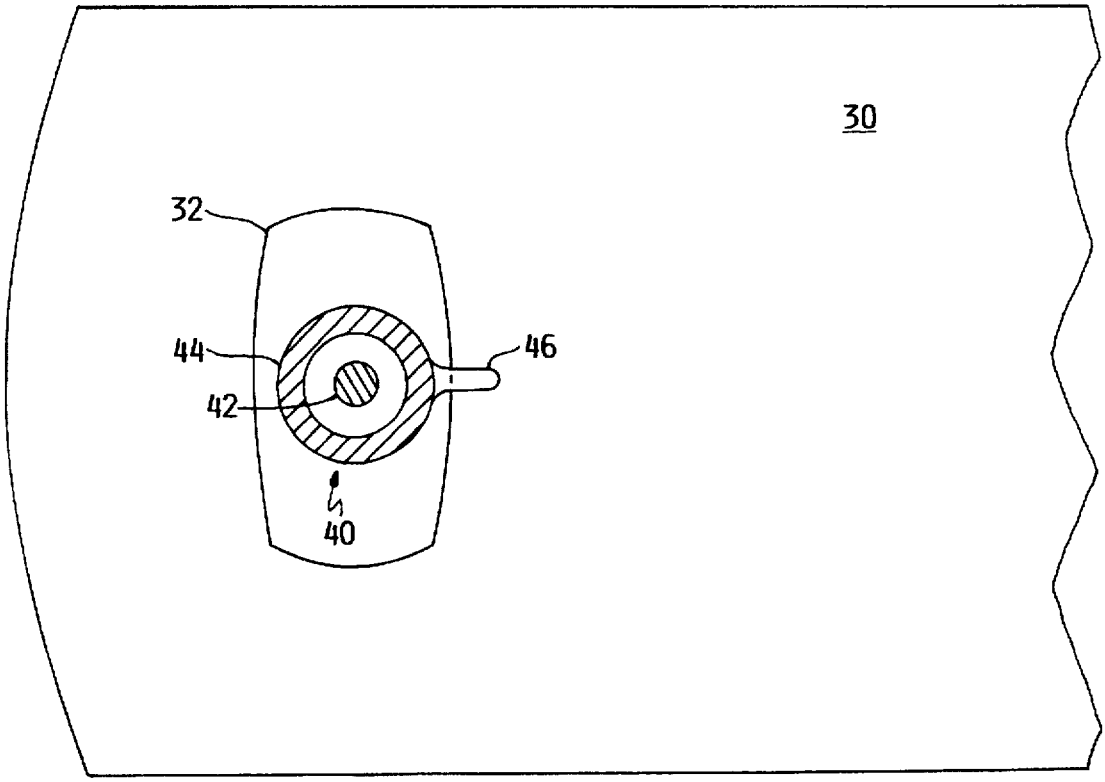
FIG. 3 shows a plan view of one end of a window blind slat and pull cord with one embodiment of my invention wherein the outer element of the pull cord has an extension which is affixed to the slat.

FIG. 3 depicts another embodiment of my invention, in which the outer element 44 has a band extension 46 which is affixed to the slat 30. The band extension 46 can be woven as part of the outer element 44, or can be attached to the outer element 44 later, such as by bonding or sewing. It is recommended that the band extension 46 be affixed to the slat 30 at a point near the crosswise center of the slat 30 to avoid interference with the pitch altering function of the ladder 26 and adjuster 28. The band extension 46 can be affixed to the slat 30 by glue, fusion, or any other bonding means compatible with the materials used in the slats and the band extension, which means will be known to those reasonably skilled in the art.

Figure 4:
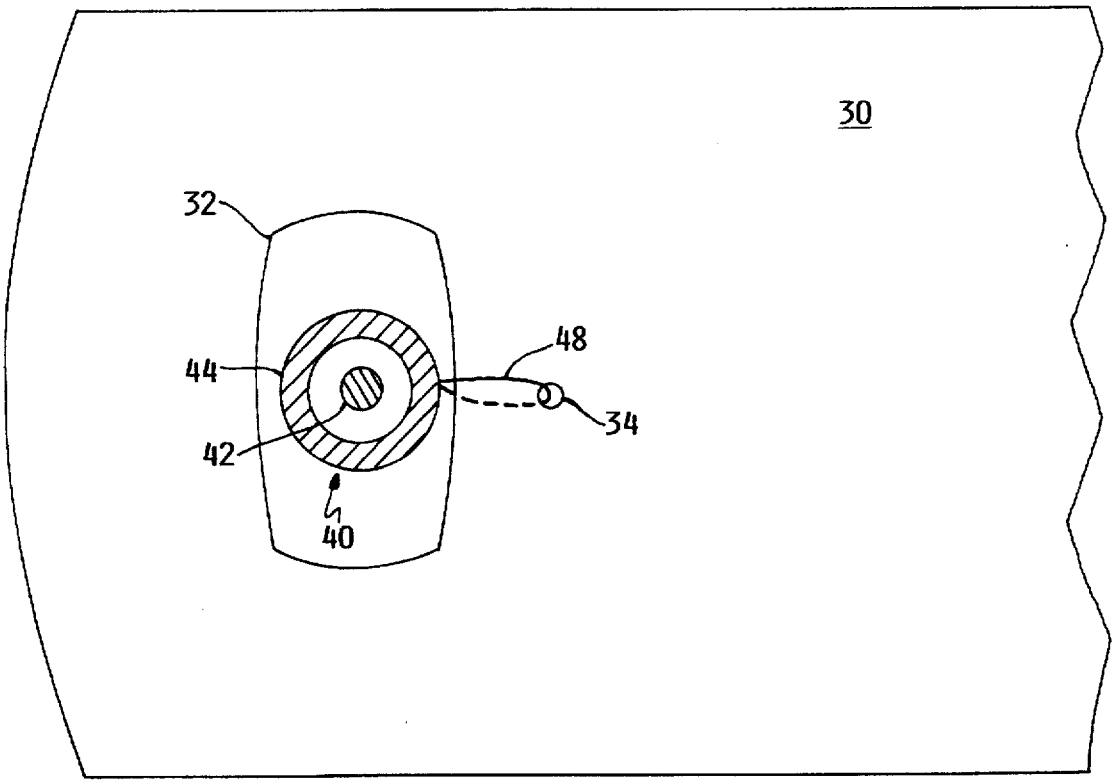
FIG. 4 shows a plan view of one end of a window blind slat and pull cord with one embodiment of my invention wherein the outer element of the pull cord has an extension loop which is affixed through an auxiliary hole in the slat.

FIG. 4 shows a third embodiment of my invention, wherein the slat 30 has an auxiliary hole 34 for accommodating a loop extension 48 of the outer element 44. The auxiliary hole 34 is preferably located at a point near the crosswise center of the slat 30 to avoid interference with the pitch altering function of the ladder 26 and adjuster 28. The loop extension 48 can be woven as part of the outer element 44, or can be attached to the outer element 44 later, such as by bonding, sewing, or clamping. The loop extension 48 can be formed of one long strip, with the outer end inserted through the auxiliary hole 34 and attached back at the outer element 44; or it can be woven as two strips which are joined after insertion through the auxiliary hole 34.

Figure 5:
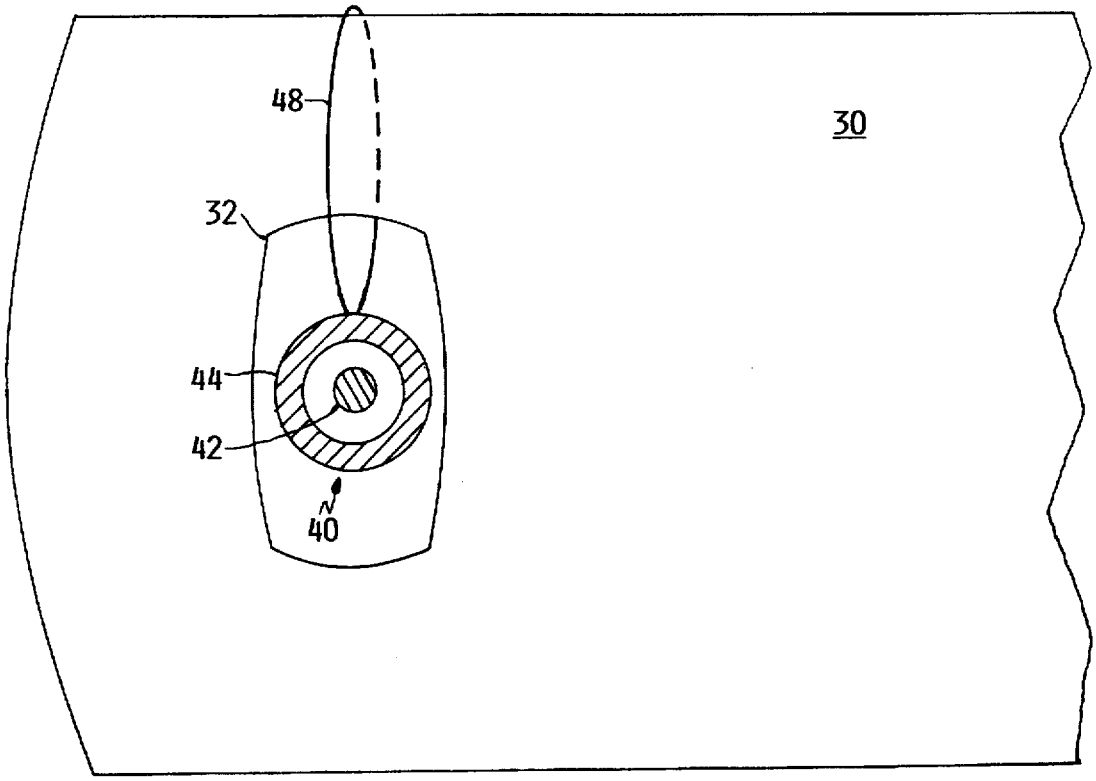
FIG. 5 shows a plan view of one end of a window blind slat and pull cord with one embodiment of my invention wherein the outer element of the pull cord has an extension loop which is affixed over a portion of the slat.

FIG. 5 depicts a fourth embodiment of my invention, wherein no auxiliary hole 34 is required and the loop extension 48 of the outer element 44 is wrapped around one half of the slat 30. As in the third embodiment, the loop extension 48 can be woven as part of the outer element 44, or can be attached to the outer element 44 later, such as by bonding, sewing, or clamping. The loop extension 48 can be formed of one long strip, with the outer end wrapped around one half of the slat 30 and attached back at the outer element 44; or it can be woven as two strips which are joined after wrapping around the slat 30.

Figure 6:
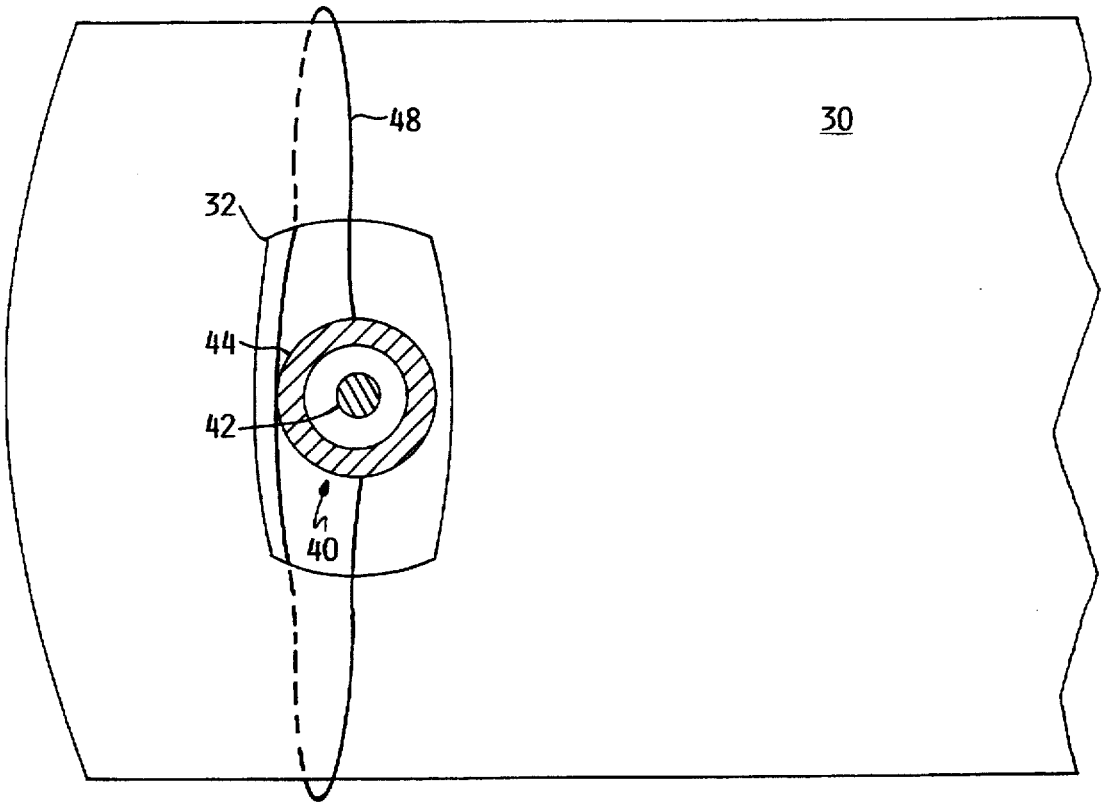
FIG. 6 shows a plan view of one end of a window blind slat and pull cord with one embodiment of my invention wherein the outer element of the pull cord has an extension loop which is affixed over the end of the slat.
Figure 7:
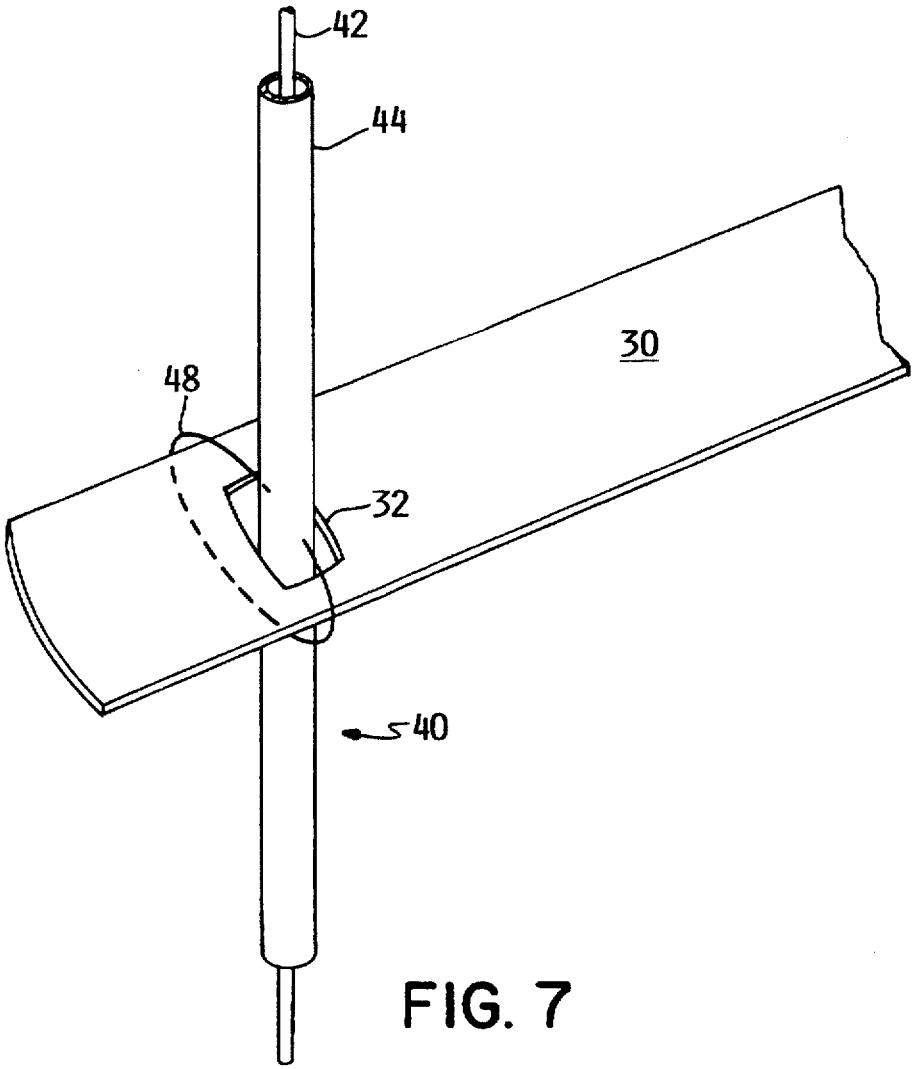
FIG. 7 is a perspective view of the embodiment of my invention shown in plan view in FIG. 6.

FIG. 6 depicts a fifth embodiment of my invention, wherein the loop extension 48 is wrapped around the end of the slat 30. FIG. 7 is a perspective view of the embodiment depicted in FIG. 6. As in the fourth embodiment, the loop extension 48 can be woven as part of the outer element 44, or can be attached to the outer element 44 later, such as by bonding, sewing, or clamping. The loop extension 48 can be formed of one long strip, with the outer end wrapped around the end of the slat 30 and attached back at the outer element 44; or it can be woven as two strips which are joined after wrapping around the slat 30. However, a preferred embodiment is for the loop extension 48 to be woven as a complete loop as part of the outer element, which reduces the amount of assembly required.

Figure 8:
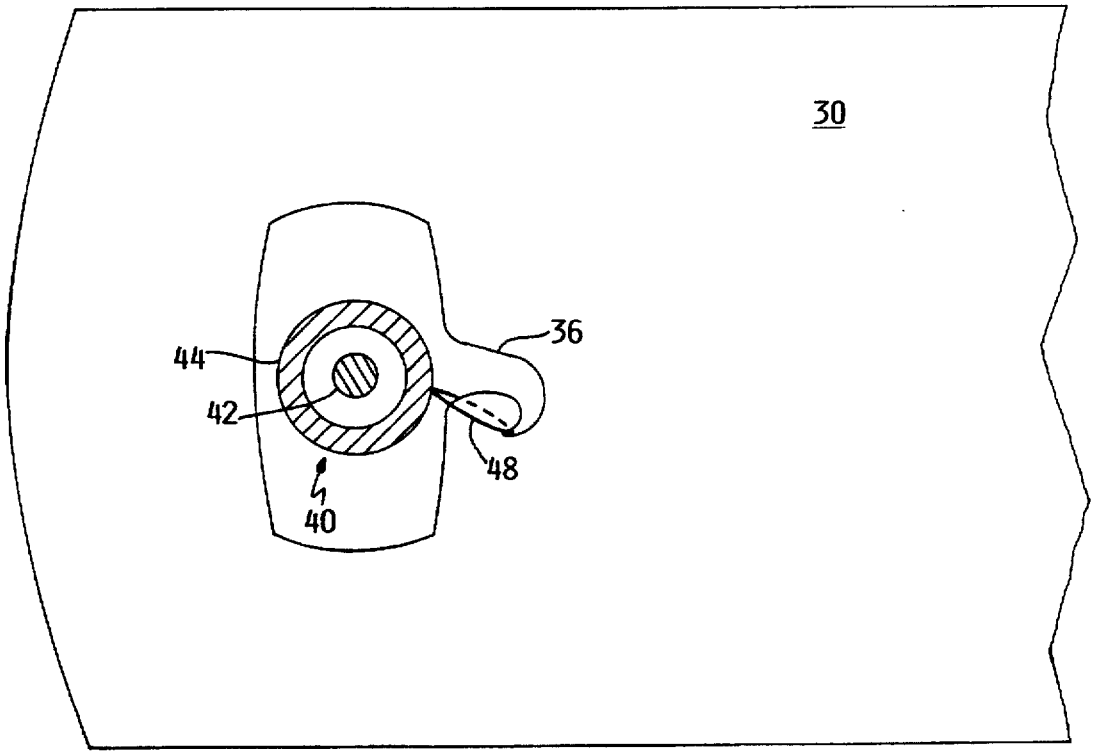
FIG. 8 shows a plan view of one end of a window blind slat and pull cord with one embodiment of my invention wherein the outer element of the pull cord has an extension loop which is affixed over a hooked portion of the hole in the slat.

FIG. 8 depicts a sixth embodiment of my invention, wherein the hooked cord hole 36 is formed with a hook for attaching the loop extension 48. This embodiment, while requiring assembly, eliminates the need for bonding the outer element 44 to the slat 30.

Figure 9:
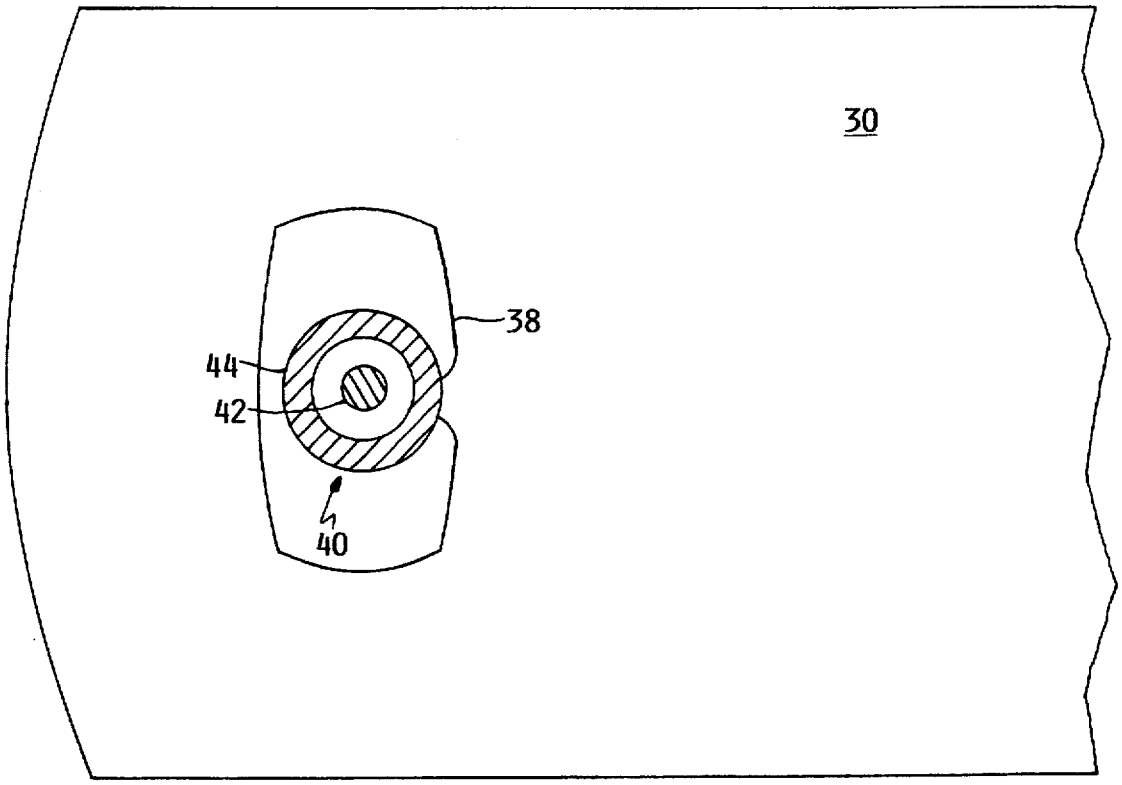
FIG. 9 shows a plan view of one end of a window blind slat and pull cord with one embodiment of my invention wherein the outer element of the pull cord is affixed directly to an intruding portion of the hole in the slat.

FIG. 9 depicts a seventh embodiment of my invention, in which the intrusion cord hole 38 is formed with an intrusion for attaching the outer element 44. In this embodiment, as in my first embodiment, the outer element 44 is bonded to the intrusion cord hole 38 with glue or the like. Other methods of bonding the outer element 44 to the cord hole 32 will be apparent to those skilled in the art. It is preferable that the intrusion be located at a point near the crosswise center of the slat 30 to avoid interference with the pitch altering function of the ladder 26 and adjuster 28.

Figure 10:
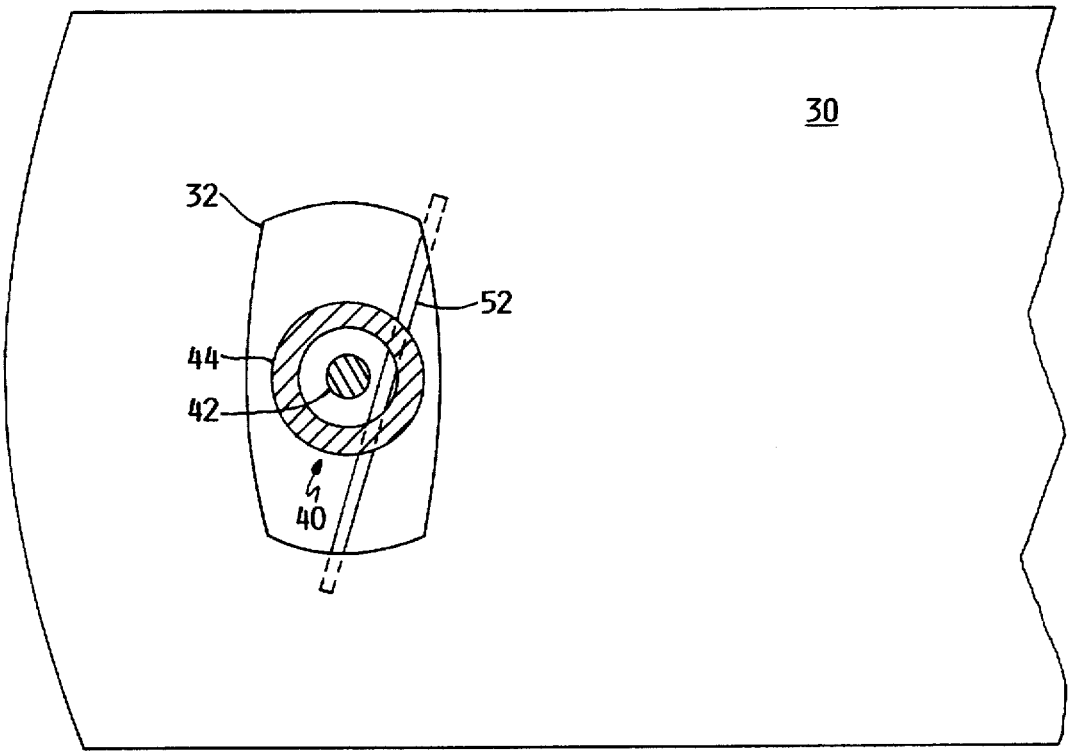
FIG. 10 shows a plan view of one end of a window blind slat and pull cord with an alternative embodiment of my invention wherein the outer element of the pull cord is restricted from passing through the cord hole by a rigid element affixed to the outer element of the pull cord.

FIG. 10 depicts an eighth embodiment of my invention, in which a rigid element such as a pin 52, which is larger than the largest dimension of the cord hole 32, pierces or is affixed to the outer element 44 to create a barrier against passage of the outer element 44 through the cord hole 32. Although a rigid pin is depicted, elements of semi-rigid materials, as well as shapes other than pins, would function as well to prevent the outer element 44 from being pulled through the cord hole 32. In this, as in all of the other embodiments, the inner element 42 remains free to travel through the outer element 44.

USE

As the improved window blind of my invention is hanging in place, its pull cords 40 are attached to slats 30, or restricted from passing through the cord holes 32 in the slats 30, so that the pull cords 40 cannot be pulled outward from the window blind to create a hazardous loop of cord.

As the inner elements 42 of the pull cords 40 are pulled to raise the window blind 20, the inner elements 42 move freely through the outer elements 44 and lift the bottom rail 22, which in turn lifts each of the slats 30 as it is raised. The outer elements 44 are constrained from rising with the inner elements 42 by their attachments to the slats 30, or are restricted from being pulled through one or more cord holes by their attached rigid elements; as the inner elements 42 rise and lift the bottom rail 22 and the slats 30 the outer elements 44 of the pull cords 40 are compressed between the slats. In this raised configuration, the tension on the inner element 42 of each pull cord 40 prevents it from being pulled outward to create a hazard.

As the inner elements 42 are loosened to allow the bottom rail 22 and the slats 30 to fall back in place, the outer elements 44 are extended between the slats and again perform their function of preventing a hazardous loop of pull cord from being pulled outward from the window blind.

ADVANTAGES

My invention economically reduces the hazard inherent in window blinds operated with a pull cord, while maintaining their usefulness.

Although the present invention has been described in considerable detail with reference to certain preferred versions thereof, other versions will be apparent to those skilled in the art. Therefore, the invention should not be construed as limited to the specific form shown and described, but instead is as set forth in the following claims.

I claim:

1. An improved window blind comprising a bottom rail and a head rail;

two or more pull cords connecting the bottom rail to the head rail, for raising and lowering the window blind, multiple slats between the bottom rail and the head rail, each of said slats having a cord hole for the passage of each pull cord therethrough, the cord holes of each slat aligned with the pull cords;

wherein the improvement comprises:

(a) each pull cord having a length and comprising an inner element and a longitudinally compressible outer element, the inner element used for raising and lowering the bottom rail and the slats, and the outer element used for attaching the pull cord to the slats, said outer element (1) encompassing the inner element over a portion of the length of the inner element, and (2) affixed to one or more slats of the window blind.

2. The window blind of claim 1, wherein the outer element comprises an extension outward from said outer element and said extension is affixed to the slat.

3. The window blind of claim 1, wherein the outer element comprises an extension loop and said extension loop encircles a portion of the slat.

4. The window blind of claim 3, wherein one or more holes of the slats comprise a hook for attachment of the extension loop of the outer element and said extension loop is attached to the hook.

5. The window blind of claim 1, wherein one or more holes of the slats comprise an intrusion for attachment of the outer element and said outer element is affixed to the intrusion.

6. An improved window blind comprising a bottom rail and a head rail;

two or more pull cords connecting the bottom rail to the head rail, for raising and lowering the window blind, multiple slats between the bottom rail and the head rail, each of said slats having a cord hole for the passage of each pull cord therethrough, the cord holes of each slat aligned with the pull cords;

wherein the improvement comprises:

(a) each pull cord having a length and comprising an inner element and a longitudinally compressible outer element, the inner element used for raising and lowering the bottom rail and the slats, and the outer element used for attaching the pull cord to the slats, said outer element (1) encompassing the inner element over a portion of the length of the inner element, and (2) restricted from being pulled through one or more cord holes.

* * * * *